US007503084B1

(12) United States Patent
Terry

(10) Patent No.: US 7,503,084 B1
(45) Date of Patent: Mar. 17, 2009

(54) INTEGRATED MATTRESS LEVELING SYSTEM

(76) Inventor: Michael Norman Terry, 1710 Wild Rose Way, Southlake, TX (US) 76092

( * ) Notice: Subject to any disclaimer, the term of this patent is extended or adjusted under 35 U.S.C. 154(b) by 123 days.

(21) Appl. No.: 11/066,411

(22) Filed: Feb. 25, 2005

(51) Int. Cl.
*A47C 19/00* (2006.01)
*A47D 7/00* (2006.01)
*A47C 31/00* (2006.01)
*A47C 23/00* (2006.01)

(52) U.S. Cl. ..... 5/8; 5/11; 5/310; 5/200.1; 5/307

(58) Field of Classification Search ..... 5/8, 5/310, 200.1, 201, 202, 203, 11, 286, 307, 5/2.1, 9.1
See application file for complete search history.

(56) References Cited

U.S. PATENT DOCUMENTS

| | | | | | |
|---|---|---|---|---|---|
| 484,975 | A | | 10/1892 | Perry | |
| 548,005 | A | | 10/1895 | Miller | |
| 609,496 | A | | 8/1898 | Buchanan | |
| 987,064 | A | | 3/1911 | Grotenhuis | |
| 1,088,468 | A | | 2/1914 | Williams | |
| 1,670,601 | A | * | 5/1928 | Weaver | 5/607 |
| 1,682,577 | A | | 8/1928 | Littlefield | |
| 1,728,422 | A | * | 9/1929 | Lundstrom | 5/118 |
| 2,495,494 | A | * | 1/1950 | Ziegenfuss | 5/2.1 |
| 2,523,987 | A | * | 9/1950 | Fox | 5/8 |
| 2,651,788 | A | | 9/1953 | Forwood | |
| 2,908,918 | A | | 10/1959 | Hopkes | |
| 2,986,746 | A | * | 6/1961 | Jackson | 5/8 |
| 3,008,176 | A | * | 11/1961 | Paine et al. | 16/273 |
| 3,031,689 | A | * | 5/1962 | Sark | 5/310 |
| 3,274,625 | A | | 9/1966 | Metzger | |
| 4,080,674 | A | * | 3/1978 | Fredman et al. | 5/310 |
| 4,101,990 | A | | 7/1978 | Holland | |
| 4,222,135 | A | * | 9/1980 | Mizelle | 5/310 |
| 4,263,683 | A | * | 4/1981 | Knoke | 5/200.1 |
| 4,312,088 | A | * | 1/1982 | Webb | 5/600 |
| 4,430,763 | A | * | 2/1984 | Whitehead | 5/200.1 |
| 4,449,261 | A | | 5/1984 | Magnusson | |
| 4,524,471 | A | * | 6/1985 | Mansouri et al. | 5/8 |
| 4,536,904 | A | * | 8/1985 | Whitehead | 5/201 |
| 4,597,120 | A | | 7/1986 | Fogel | |
| 5,172,442 | A | * | 12/1992 | Bartley et al. | 5/611 |

(Continued)

*Primary Examiner*—Patricia L Engle
*Assistant Examiner*—Jonathan J Liu
(74) *Attorney, Agent, or Firm*—K&L Gates LLP

(57) ABSTRACT

A mattress leveling system designed to provide individually adjustable mattress heights, where mattresses of different firmness and thickness can be integrated into one bed with a level sleep surfaces sharing a common plane and held juxtaposed. Each mattress or mattress set is securely supported within a frame assembly with independently height adjustable legs. Users can integrate individual mattresses, which provide adequate firmness to meet the needs and desires of each of the users, forming one bed system customized to provide optimal comfort for both partners. An advantage of this design provides users with the ability to integrate into one bed, commonly available standard or non-standard adult size mattresses of differing thickness from different manufacturers, taking advantage of the latest sleep comfort technologies available on the market. Another advantage is the ability to exchange one mattress of the integrated bed without affecting the other mattress. Further advantages are, the ability to level the mattresses on uneven flooring, and the ability to integrate an unlimited number of mattresses into one bed.

In a simple configuration, standard king size bedding could be used with two extended-twin size mattress sets integrated to form an attractive bed.

13 Claims, 4 Drawing Sheets

U.S. PATENT DOCUMENTS 5,243,720 A * 9/1993 Harrow ..... 5/201
5,797,152 A 8/1998 Wiesch
5,815,860 A * 10/1998 Mitchell ..... 5/236.1
5,996,145 A 12/1999 Taylor
6,112,347 A 9/2000 Tharalson
6,125,484 A * 10/2000 Thomson ..... 5/200.1
6,138,305 A * 10/2000 Smith ..... 5/660
6,216,289 B1 4/2001 Woods
6,338,172 B1 * 1/2002 Taylor et al. ..... 5/200.1
6,397,413 B2 * 6/2002 Epstein et al. ..... 5/201
6,941,596 B2 * 9/2005 Schuman et al. ..... 5/286

* cited by examiner

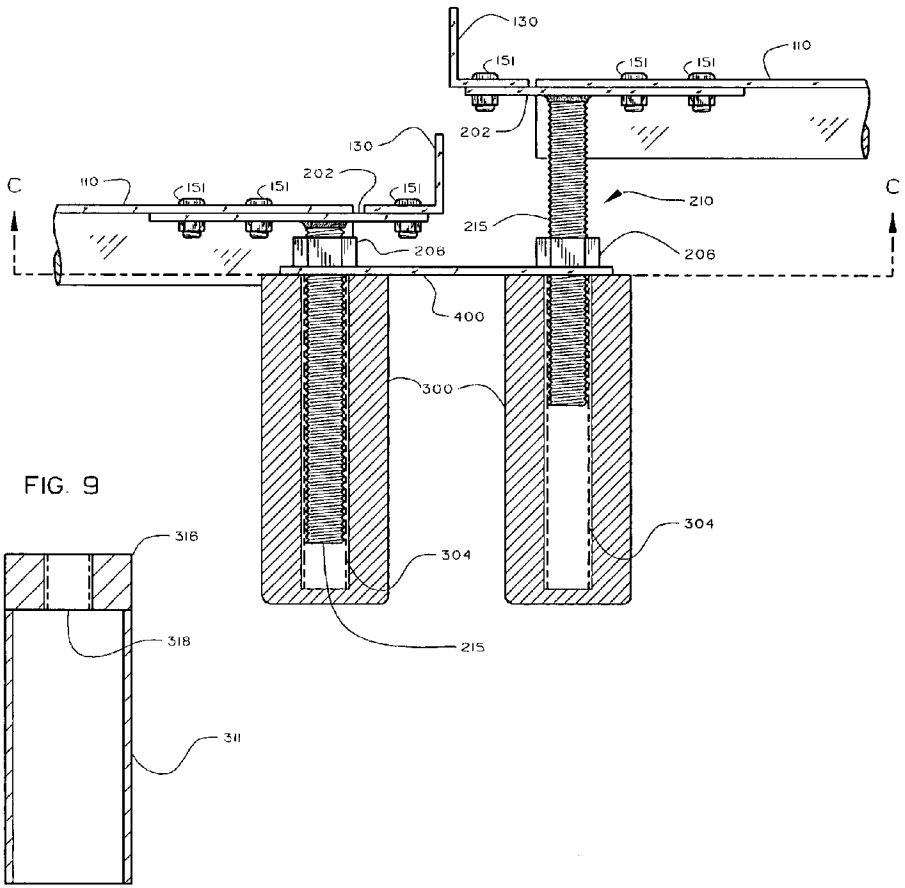
FIG. 4
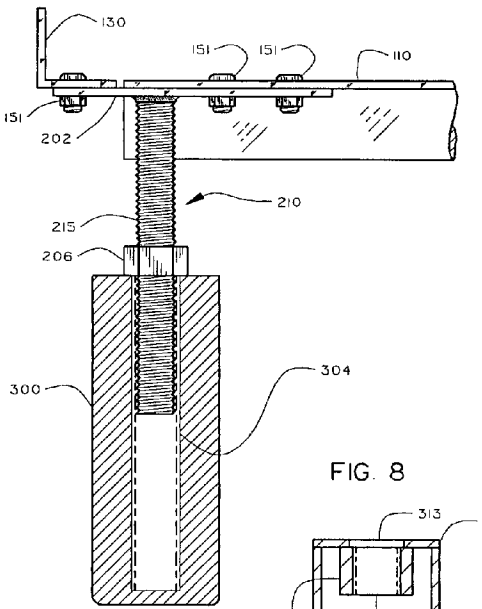
FIG. 3
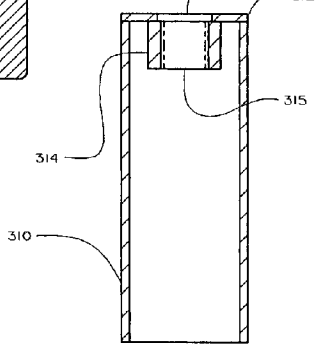
FIG. 8
FIG. 9

INTEGRATED MATTRESS LEVELING SYSTEM

BACKGROUND OF THE INVENTION

1. Field of Invention

This invention relates to mattress support systems, specifically to a plurality of mattress support units having means to continuously vertically adjust the mattress support units and maintain the mattress support units in fixed juxtaposition.

2. Background of the Invention

Bedding manufacturers have traditionally produced mattresses sized for two adults in industry standard bed sizes of double, queen, and king. Commonly such mattresses, no matter how large, are made of uniform construction and materials so that the entire mattress of a bed provides the same degree of firmness and feel to both adults using it.

People, however, vary considerably in their desires and needs as to mattresses firmness. Often times, people who want to sleep together have very different ideas about what is a comfortable mattress. Also, people of different weights usually need different amounts of support to place their bodies in a comfortable sleeping position. Because people generally spend a significant portion of their lives in bed, it is important that the mattress provide adequate firmness to meet the needs and desires of each of the users. Unfortunately, conventional bed designs for the most part tend to force both persons to compromise their individual desires, or at least force one of the persons to do so. Hence, it often happens that neither person is truly comfortable on a conventional bed or to the extent one is comfortable, the other is not.

The problem is further compounded by the fact that people's mattress needs often change throughout their lives. For example, as one gets older, he or she may desire a firmer mattress to prevent back strain. Likewise, after an injury or strain to a back, one may temporarily or permanently desire a different firmness of mattress. However, the person's sleeping partner may have no such desire or need to change mattress.

One way of solving this problem is to push two single beds together with each single bed having a separate and distinct mattress suited to each particular individual. Unfortunately, this solution often leaves an uncomfortable and unsightly step at the point where the two beds meet. For example, a thicker, plusher, mattress is likely to have a sleep surface noticeably higher than a typically thinner, firmer, mattress. Another problem with this arrangement is that the two independent single beds may tend to separate from each other, causing a gap between the mattresses. Thus, people who rely on using two single beds pushed together to form a double bed will suffer from uneven sleep surfaces and gaps between the sleep surfaces.

Attempts have been made to provide pair wise assembly of bed frames wherein at least one bed frame is height adjustable as described in U.S. Pat. No. 6,112,347 issued to Tharalson, and U.S. Pat. No. 987,064 issued to Grotenhuis. However, each of the described systems suffers from one or more drawbacks in manufacture, assembly, or effectiveness.

U.S. Pat. No. 6,112,347 issued to Tharalson on Sep. 5 details a bedside sleeping enclosure with height-adjustable legs, for use with babies and very young children. Tharalson fails to address co-joining adult size mattresses, or the mattress comfort needs of adults.

U.S. Pat. No. 987,064 issued to Grotenhuis Mar. 14, 1911 specifies two separate beds or couches that may be brought together to form twin beds. While Grotenhuis addresses the desire for a level bed with a flat top, the adjustable devise has only two positions, "either clear up, or clear down. There can be no intermediate positions", and offers no solution for providing continuously selective height adjustable sleep surfaces, or stabilizing the bed on uneven flooring.

Attempts have been made to provide variable firmness bedding systems as described U.S. Pat. No. 3,274,625 issued to H. W. Metzger, U.S. Pat. No. 2,651,788 issued to D. F. Forwood, U.S. Pat. No. 4,597,120 issued to Fogel et al., and U.S. Pat. No. 4,449,261 issued to Magnusson. However, each of the described systems suffers from one or more drawbacks in manufacture, assembly, or effectiveness.

U.S. Pat. No. 3,274,625 issued to H. W. Metzger on Sep. 27, 1966. Metzger's solution uses an inner spring mattress having a covering that includes a first quilting pattern for a first person and a second quilting pattern on the other side of the bed for a second person. The first and second quilting patterns are intended to provide different firmness. Since quilting pattern is the only variable, only a limited degree of firmness change may be realized.

U.S. Pat. No. 2,651,788 issued to D. F. Forwood on Sep. 15, 1953 illustrates a mattress that includes first and second spring units encased in a single padded cover. The spring units are intended to provide different firmness. However, comfort and firmness options are limited to the available mattress inserts.

U.S. Pat. No. 4,597,120 issued to Fogel et al. on Jul. 1, 1986 and U.S. Pat. No. 3,732,585 issued to Krehbiel on May 15, 1973 both show dual bladder waterbeds intended to provide mattresses with individually adjustable firmness. These mattresses provide no solution if either person does not like a waterbed.

U.S. Pat. No. 4,449,261 issued to Magnusson on May 22, 1984 shows a two-person mattress having a frame portion with a cavity. The cavity is filled with first and second inserts. The Magnusson mattress is intended to provide a range of firmness for each person using the two-person mattress. However, comfort and firmness options are limited to the available mattress inserts.

None of the prior art, of which Tharalson U.S. Pat. No. 6,112,347; Grotenhuis U.S. Pat. No. 987,064; Metzger U.S. Pat. No. 3,274,625; Forwood U.S. Pat. No. 2,651,788; Fogel et al. U.S. Pat. No. 4,597,120; and Magnusson U.S. Pat. No. 4,449,261 are typical, show or even suggest the overall configuration and the advantages inherently embodied in the features of the present invention.

Taken as a whole, the above references to the state of the art illustrate and teach away from any suggestion to combine commonly available adult size mattresses or mattress sets of differing thickness from different manufacturers within a system to provide variable sleep comfort and eliminate the problems of gaps or uneven sleep surfaces.

In conclusion, insofar as I am aware, no mattress support system formerly developed allows:

1. Incorporation of commonly available standard or non-standard adult size mattresses or mattress sets of differing thickness, without the defect of gap and uneven sleep surfaces.
2. The combination of an indefinite number of adult size mattresses into an integrated sleep system.

SUMMARY

The present invention, an integrated mattress leveling system, comprises of structures to support multiple adult size mattresses of different thickness, with means to level the sleep surfaces of the combined mattresses, while maintaining a fixed relative juxtaposition between the mattress support units. This invention allows adults to incorporate individual mattresses, which provide adequate firmness to meet the needs and desires of each of the users, into one level sleep system without gap between the mattresses. As a result, users can integrate mattresses from multiple manufacturers, taking advantage of the latest sleep comfort 115 technologies available on the market. Also, this invention permits the possibility to change an individual mattress, without having to change the other, at which time, mattress height(s) can then be readjusted to level the new mattress combination.

Accordingly, several objectives and advantages of the invention are to provide a means of integrating an individual's mattress of choice with that of a partner's into a practical and attractive sleep system with level sleep surfaces, allowing users to integrate commonly available standard or non-standard adult size mattresses or mattress sets of differing thickness from different manufacturers, allowing users to exchange individual mattresses of a bed without affecting their partner's comfort, and to allow any number of mattresses to be integrated into one bed. Further objectives and advantages will become apparent from a study of the following description and the accompanying drawings.

DRAWINGS

Figures

FIG. 3 is a partial cross-sectional view as seen from line A-A of FIG. 2.

FIG. 4 is a partial cross-sectional view as seen from line B-B of FIG. 2.

Figure 5:
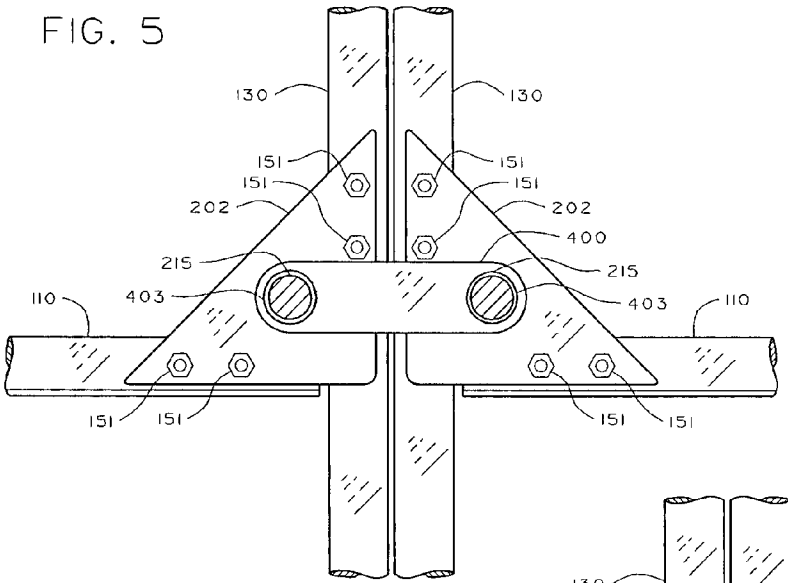
FIG. 5 is a cross-sectional view taken along line C-C of FIG. 4.
Figure 7:
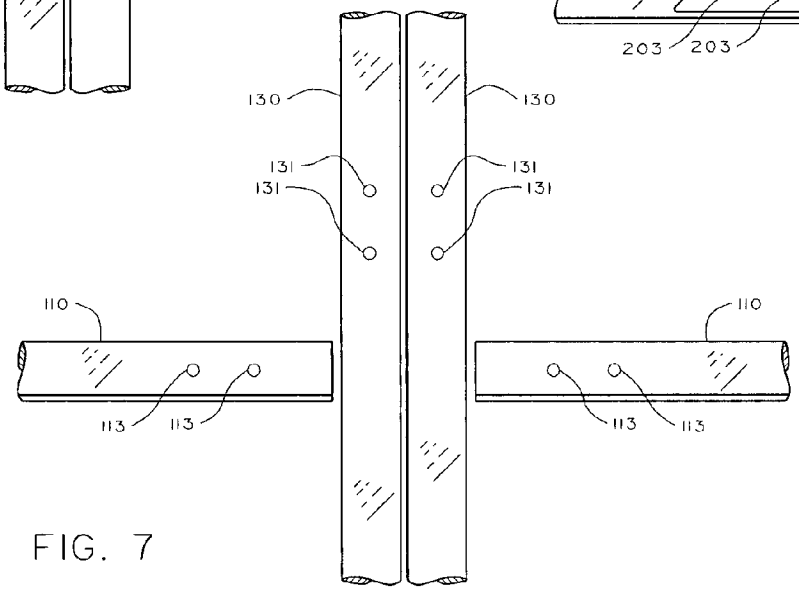

FIG. 7 is a partial view of FIG. 5, without link 400, means 151, or leg 210.

FIG. 8 is an alternative embodiment of foot 300

FIG. 9 is an alternative embodiment of foot 300

DETAILED DESCRIPTION

Before explaining at least one embodiment of the invention in detail, it is to be understood that the invention is not limited in its application to the details of construction and to the arrangements of the components set forth in the following description. Additionally, the present invention is not limited to the construction illustrated in the drawings. The invention is capable of other embodiments and of being practiced in various ways. Also, it is to be understood that the phraseology and terminology employed herein are for the purpose of description and should not be regarded as limiting. Therefore, the claims should be regarded as including such equivalent construction.

Figure 1:
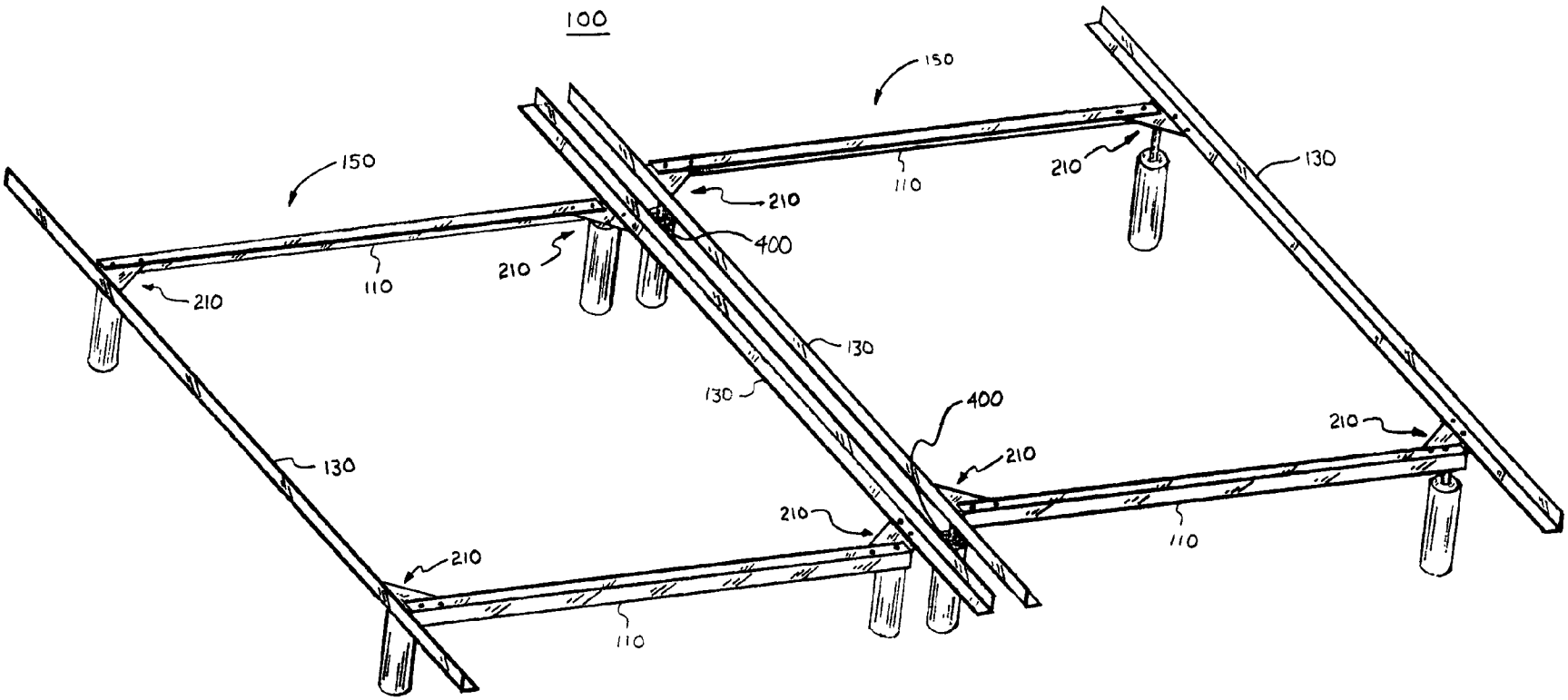
FIG. 1 is a perspective view of a mattress support system constructed in accordance with the invention.
Figure 2:
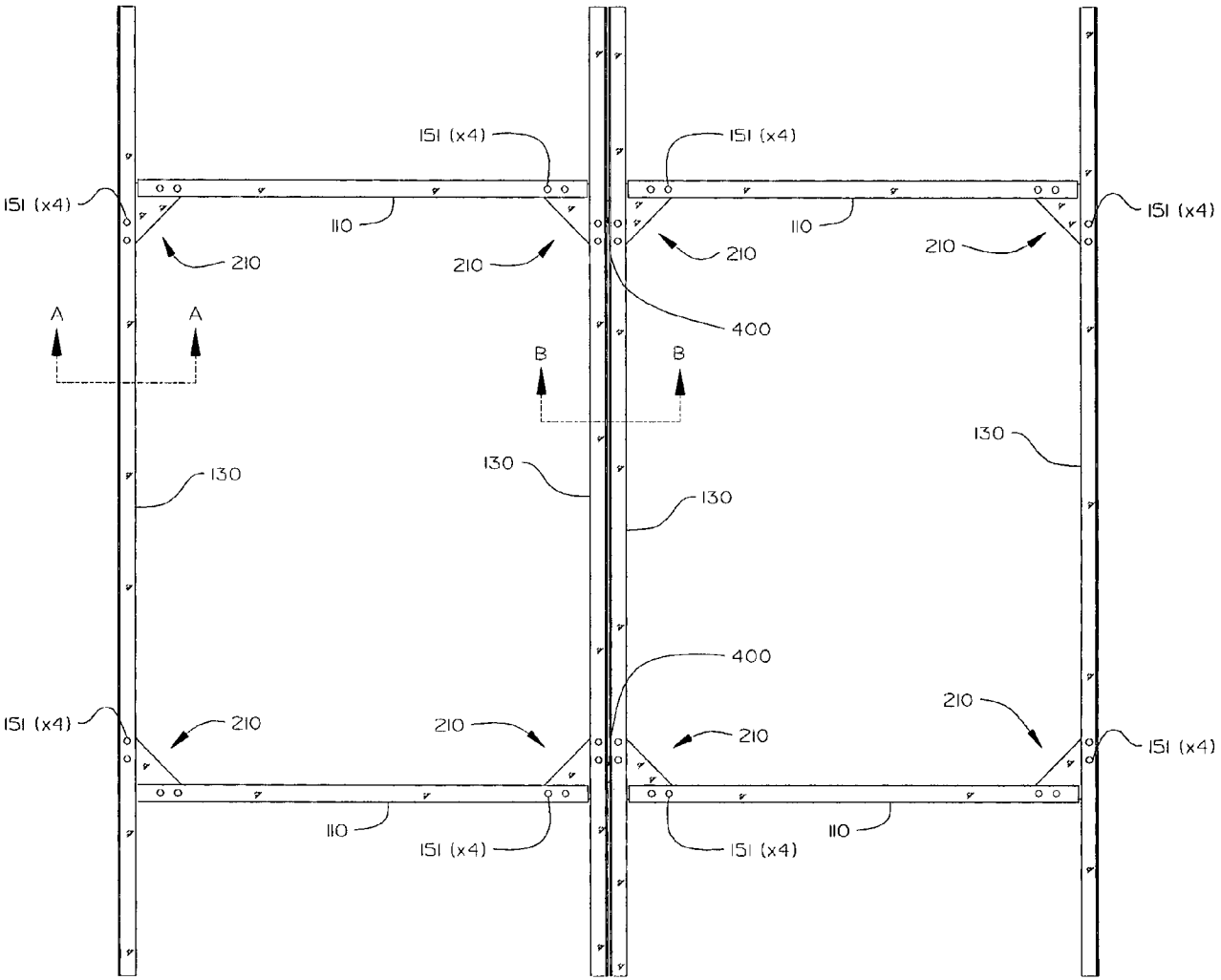
FIG. 2 is top view of the mattress support system shown in FIG. 1.

With reference to FIG. 1, an integrated mattress leveling system according to the present invention is shown therein and generally denoted by the numeral 100. Integrated mattress leveling system 100 comprises a plurality of modular mattress support units 150, coupled in fixed relative juxtaposition by means of links 400. Mattress leveling system 100 comprises versatile components that may be selectively adjusted to support a plurality of box springs and mattresses (not shown) of different thickness, providing level sleep surfaces (i.e., the upper most surfaces of the mattresses), of common height in a fixed juxtaposition.

Figure 6:
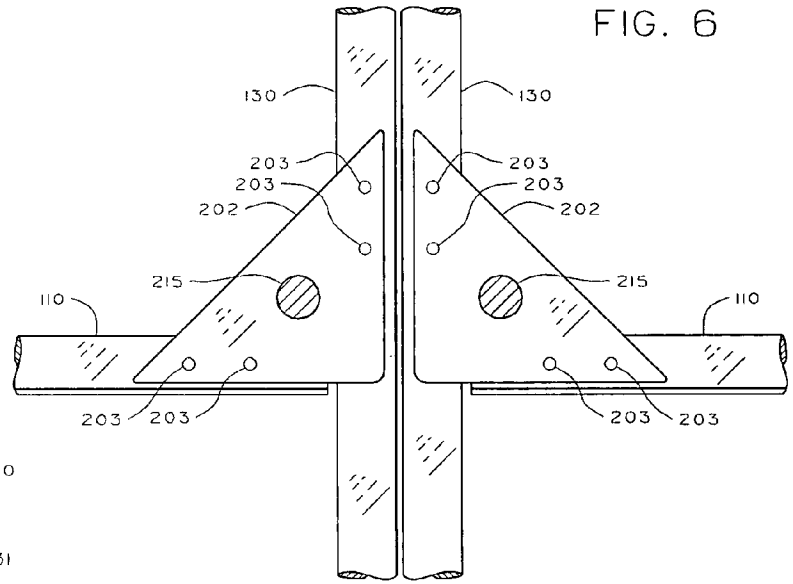
FIG. 6 is a partial view of FIG. 5, without link 400, or means 151.

Each mattress support unit 150 comprises of a plurality of slats 110 and rails 130 forming a mattress support structure to frame and support most commonly available standard or non-standard size mattresses or mattress sets (not shown), and height adjustable bed legs 210 positioned at spaced locations along each side at user-selected height. Transverse slats 110 are positioned towards the opposed ends of the mattress support units and between the rails 130 positioned along either side. As shown in FIGS. 1, 2, 3, 4, 5, and 6, slats 110 and rails 130 are detachably mounted upon and supported by bed legs 210. Support 202 includes at least one attachment hole 203 configured to locate and align with at least one attachment hole 113 in slat 110 and at least one attachment hole 133 in rail 130, as shown in FIGS. 6, and 7. Beds leg 210 detachably attaches to slat 110 and rail 130 with detachable attachment means 151, as shown in FIGS. 1, 2, 3, 4, and 5. It is evident from the symmetrical construction of each mattress support unit that the opposed ends are interchangeable, and the opposed sides are interchangeable.

The overall height if bed leg 210 (i.e., the distance between the bottom of foot 300 and the top of support 202), and therefore slat 100 and rail 130, may be continuously adjusted by rotating foot 330 about externally threaded stanchion 215. Foot 300 may be held against axial movement in relation to stanchion 215 by tightening nut 206 against foot, as shown in configuration of FIG. 3.

Rails 130 are preferably constructed of metal beams using an L-shaped cross-section wherein a vertical portion of the L-shaped cross-section projects upwardly to inhibit sideward movement of the mattress, and a horizontal portion supports the weight thereof. Slat 110 is preferably constructed of metal beams using an L-shaped cross-section wherein a horizontal portion supports the weight of the mattress, and a vertical portion of the L-shaped cross-section projects downwardly to avoid interference with the mattress and bed legs 210.

Foot 300 is preferably made of metal with parallel upper and lower opposed ends. The foot comprises an internally threaded bore 304 open at the upper end of the foot and extending downwardly toward the lower end of the foot. The thread of the bore is complementary to the threads of stanchion 215. Foot 300 threadedly and rotatably engages with stanchion 215 to provide vertical height adjustment of bed leg 210. It will be evident from the drawing that mattress support unit height may be adjusted by selectively rotating foot 300 with respect to stanchion 215.

An alternative embodiment of foot 300, shown in FIG. 8, comprises a cylinder 310 with parallel upper and lower opposed ends, a support 312 with parallel upper and lower opposed surfaces, fixed to the upper end of cylinder 310, and an internally threaded fitting 314 fixed to the lower surface of support 312. Threaded bore 315 of fitting 314 is aligned with an aperture 313 in support 312, and configured to threadedly and rotatably engage with stanchion 215 to provide height adjustment.

Yet another alternative embodiment of foot 300, shown in FIG. 9, comprises a cylinder 311 with parallel upper and lower opposed ends, support 316 with parallel upper and lower opposed surfaces, fixed to the upper end of cylinder 311, and an internally threaded bore 318 open at the upper surface of support 316 and extending downwardly through the lower surface of the support. The thread of bore 318 is complementary to the threads of stanchion 215, configured to threadedly and rotatably engage with stanchion 215 to provide height adjustment.

The male portion of bed leg 210 is comprised of upper and lower opposed ends, with stanchion 215 having external threads extending upwardly from the lower end and support 202 at the upper end. Support 202 is preferably made of metal plate with parallel upper and lower surfaces, wherein the lower surface is fixed to the upper end of stanchion 215. The support 202 is preferably shaped as a right triangle with attachment holes 203 symmetrical about the median, as shown in FIG. 6, configured to locate and align with at least one attachment hole 113 in slat 110 and at least one attachment hole 133 in rail 130, as shown in FIG. 7, thus making them interchangeable at all rail to slat interfaces.

Proximal bed legs 210 of mattress support units 150 are preferably coupled at both ends and maintained in fixed juxtaposition be securing stanchions 215 within cavities 403 of link 400, as shown in FIGS. 1, 2, 4, and 5, thus allowing head and foot ends of the mattress support units 150 to be secured when the elevations of the mattress support structures (defined by the slats 110 and rails 130) of the mattress support unit 150 differ, where the elevation of the mattress support structure is measured from the floor to the level of the slats 110 and rails 130. Link 400 is preferably made of rigid material, of particular length, with cavities 403 at either end, configured to allow passage of stanchion 215. In the preferred embodiment, link 400 is sandwiched between nut 206 and foot 300, of the proximal bed legs 210 of mattress support units 150. Foot 300 is secured in relation to stanchion 215, and mattress support units 150 are maintained in fixed relative juxtaposition, by tightening nut 206 to link 400 and foot 300.

Accordingly, this integrated mattress leveling system will provide:

1. the ability to integrate a mattress of one's choice with that of a partner's into a bed with level sleep surface,
2. the ability to integrate commonly available standard or non-standard mattresses or mattress sets of different thickness, into an attractive and practical bed for adults,
3. the ability to exchange one mattress, of a multiple mattress bed, and adjust the system to maintain mutually level sleep surfaces of the combined mattresses, and
4. the ability to integrate an unlimited number of mattresses into one bed.

In the preferred embodiment, two mattress support units 150 would be assembled as described. One extended-twin size box spring and mattress (not shown) would be supported by one mattress support unit 150. Another extended-twin size box spring and mattress would be supported by the other mattress support unit 150, thus forming an integrated mattress support system of approximately the same perimeter dimensions of a king size bed. In this configuration standard king sized bedding could be used on the resulting bed.

Within each mattress support unit 105, the length of slats 110 determines the distance between rails 130. The proportions shown in FIG. 1 are typical for supporting two twin-sized mattresses; however, it is apparent that slats of different or adjustable length will accommodate other standard or non-standard mattress sizes. With additional links 400, it is apparent that a plurality of mattress support units may be linked in a manner so as to integrate more than two mattresses into a bed. Notably, because foot 300 is threaded on the inside, it may be provided with a smooth, decorative, or ergonomic outer surface. As a result, foot 300 is more comfortably adjusted and more attractive than if the lower member had exposed threads. Also because bed legs 210 are independently adjustable, the bed can be stabilized on uneven floors.

It will be appreciated from the foregoing that various features and inventions as described above may be separately employed or used in different combinations. For example, a female member, as the presently described foot, could be inverted and attached to the support, with a male member extending downwardly.

The use of metal beam has the benefit of providing adequate structural rigidity combined with moderate weight and cost. Alternative embodiments may include other materials. While embodiments and applications of the invention have been shown and described, it would be apparent to those of ordinary skill in the art, after a perusal of the within disclosure, that many more modifications than mentioned above are possible without departing from inventive concepts herein.

I claim:

1. A mattress support system for supporting at least two mattresses, the mattress support system comprising:

first and second mattress support units, each of the first and second mattress support units comprising:

first and second rails;

first and second slats, wherein:

a first joint connects a first end of the first slat to the first rail;

a second joint connects a second end of the first slat to the second rail;

a third joint connects a first end of the second slat to the first rail; and a fourth joint connects a second end of the second slat to the second rail, such that the first and second rails and the first and second slats define a rectangular mattress support structure to support an adult size mattress;

a first adjustable height leg assembly connected to the first joint, wherein the first adjustable height leg assembly comprises a first foot and a first threaded stanchion, the first threaded stanchion having a first end fixedly connected to the first joint and a second end adjustably connected to the first foot;

a second adjustable height leg assembly connected to the second joint, wherein the second adjustable height leg assembly comprises a second foot and a second threaded stanchion, the second threaded stanchion having a first end fixedly connected to the second joint and a second end adjustably connected to the second foot;

a third adjustable height leg assembly connected to the third joint, wherein the third adjustable height leg assembly comprises a third foot and a third threaded stanchion, the third threaded stanchion having a first end fixedly connected to the third joint and a second end adjustably connected to the third foot; and a fourth adjustable height leg assembly connected to the fourth joint, wherein the fourth adjustable height leg assembly comprises a fourth foot and a fourth threaded stanchion, the fourth threaded stanchion having a first end fixedly connected to the fourth joint and a second end adjustably connected to the fourth foot; and a first rigid link comprising first and second apertures, wherein (i) the first threaded stanchion of the first adjustable height leg assembly of the first mattress support unit passes through the first aperture of the first link and (ii) the first threaded stanchion of the first adjustable height leg assembly of the second mattress support unit passes through the second aperture of the first link, allowing the first and second mattress support units to be secured when the elevations of the first and second support units differ, where the elevations of the mattress support units are measured from the floor to the level of the slats and rails for the first and second mattress support units.

2. The mattress support system of claim 1, wherein the first rigid link comprises a rigid plate.

3. The mattress support system of claim 1, further comprising a second rigid link, the second rigid link comprising first and second apertures, wherein (i) the third threaded stanchion of the third adjustable height leg assembly of the first mattress support unit passes through the first aperture of the second link and (ii) the third threaded stanchion of the third adjustable height leg assembly of the second mattress support unit passes through the second aperture of the second link.

4. The mattress support system of claim 3, wherein the first and second links maintain the first and second mattress support units in juxtaposition, and wherein the elevation of the mattress support structure of the first mattress support unit is greater than the elevation of the mattress support structure of the second mattress support unit.

5. The mattress support system of claim 3, further comprising:

a first tightening nut, wherein first threaded stanchion of the first adjustable height leg assembly of the first mattress support unit is threaded through the first tightening nut such that the first rigid link is between the first tightening nut and the first foot of the first adjustable height leg assembly of the first mattress support unit;

a second tightening nut, wherein first threaded stanchion of the first adjustable height leg assembly of the second mattress support unit is threaded through the second tightening nut such that the first rigid link is between the second tightening nut and the first foot of the first adjustable height leg assembly of the second mattress support unit;

a third tightening nut, wherein third threaded stanchion of the third adjustable height leg assembly of the first mattress support unit is threaded through the third tightening nut such that the second rigid link is between the third tightening nut and the third foot of the third adjustable height leg assembly of the first mattress support unit; and a fourth tightening nut, wherein third threaded stanchion of the third adjustable height leg assembly of the second mattress support unit is threaded through the fourth tightening nut such that the second rigid link is between the fourth tightening nut and the third foot of the third adjustable height leg assembly of the second mattress support unit.

6. The mattress support system of claim 5, wherein the first and second links maintain the first and second mattress support units in juxtaposition, and wherein the elevation of the mattress support structure of the first mattress support unit is greater than the elevation of the mattress support structure of the second mattress support unit.

7. The mattress support system of claim 6, wherein:

the first rigid link comprises a first rigid plate; and the second rigid link comprises a second rigid plate.

8. The mattress support system of claim 7, wherein:

the first rail is parallel to the second rail; and the first slat is parallel to the second slat.

9. The mattress support system of claim 8, wherein the first, second, third, and fourth feet of the first, second, third, and fourth adjustable height leg assemblies, respectively, of the first and second mattress support units are rotatable relative to the first, second, third, and fourth threaded stanchions, respectively, to adjust the elevations of the mattress support structures of the first and second mattress support units.

10. The mattress support system of claim 9, wherein the first foot of the first adjustable height assembly of the first mattress unit defines an internally threaded bore open at an upper end of the first foot and extending downwardly toward a lower end of the first foot, and wherein the first threaded stanchion is threaded into the internally threaded bore of the first foot.

11. The mattress support system of claim 9, wherein the first foot of the first adjustable height assembly of the first mattress unit comprises a threaded fitting at an upper surface of the first foot, and wherein the first threaded stanchion is threaded into the threaded footing of the first foot.

12. The mattress support system of claim 8, wherein, for each mattress support unit:

a first metal plate connects the first end of the first slat to the first rail at the first joint;

a second metal plate connects the second end of the first slat to the second rail at the second joint;

a third metal plate connects the first end of the second slat to the first rail at the third joint; and a fourth metal plate connects the second end of the second slat to the second rail at the fourth joint.

13. The mattress support system of claim 1, further comprising:

a first tightening nut, wherein first threaded stanchion of the first adjustable height leg assembly of the first mattress support unit is threaded through the first tightening nut such that the first rigid link is between the first tightening nut and the first foot of the first adjustable height leg assembly of the first mattress support unit; and a second tightening nut, wherein first threaded stanchion of the first adjustable height leg assembly of the second mattress support unit is threaded through the second tightening nut such that the first rigid link is between the second tightening nut and the first foot of the first adjustable height leg assembly of the second mattress support unit.

* * * * *